United States Patent [19]

Anderson

[11] 4,034,653

[45] July 12, 1977

[54] AXIAL PISTON MOTOR

[76] Inventor: Arthur F. Anderson, 767 Iowa St., Blair, Nebr. 68008

[21] Appl. No.: 546,494

[22] Filed: Feb. 3, 1975

[51] Int. Cl.[2] ..... F01B 13/04
[52] U.S. Cl. ..... 91/501
[58] Field of Search ..... 91/501, 492, 487, 499; 180/66 F

[56] References Cited

U.S. PATENT DOCUMENTS

| | | | |
|---|---|---|---|
| 2,205,913 | 6/1940 | Stacy | 91/487 |
| 2,353,730 | 7/1944 | Joy | 180/66 F |
| 2,390,590 | 12/1945 | Holmes | 91/501 |
| 3,030,933 | 4/1962 | Bergstedt | 91/501 |
| 3,621,761 | 11/1971 | Anderson | 91/501 |
| 3,866,517 | 2/1975 | Aldinger | 91/498 |

FOREIGN PATENT DOCUMENTS

| | | | |
|---|---|---|---|
| 1,128,136 | 8/1956 | France | 91/501 |
| 1,928,763 | 12/1970 | Germany | 91/492 |
| 599,683 | 11/1959 | Italy | 91/499 |
| 37,756 | 6/1958 | Poland | 91/501 |
| 1,141,855 | 2/1969 | United Kingdom | 91/498 |
| 709,183 | 5/1954 | United Kingdom | 91/501 |

*Primary Examiner*—William L. Freeh
*Attorney, Agent, or Firm*—Henderson, Strom & Sturm

[57] ABSTRACT

An axial piston motor having a fixed spindle and a rotatable assembly to which is secured a wheel or the like, wherein the motor is disposed within the wheel with the thrust races being removably secured to the angle plates and having a pair of spaced relief ports disposed opposite the inlet port and the outlet port respectively which are fluidly connected to the opposite port for balancing the load of the rotor assembly on the spindle thus providing a fixed clearance between the assembly and the spindle.

9 Claims, 7 Drawing Figures

AXIAL PISTON MOTOR

BACKGROUND OF THE INVENTION

Hydraulic motors for wheel drives are either direct drive or gear connected. The direct drive axial piston type is generally of awkward configuration because the shaft rotates thus requiring the mechanism to be disposed outboard of the wheel. Developments have been made to provide a fixed shaft or spindle and having a rotor assembly rotatably mounted thereon. The difficulty of the fixed spindle unit is the problem inherent in balancing the rotor assembly on the shaft. Generally existing units float the rotor on the spindle and the rotor cage or assembly is keyed to the rotor and journalled to the spindle. This configuration provides an extremely complex bulky unit.

It has further been observed that the thrust race and bearing cage assembly has been secured to the angle plate by snap rings. Again the complexity and expense of this type of design is undesirable.

SUMMARY OF THE INVENTION

This invention relates generally to an axial piston motor and in particular to a motor wherein the shaft is stationary and the remainder of the motor is a rotor assembly which rotates about the shaft or spindle. Mounted radially of the rotor assembly is a wheel or the like. The thrust races against which the pistons coact to provide rotary motion are snap fitted to the angle plate thus in the event of wear they can readily be replaced. In addition, the inlet port of the spindle is balanced on the opposite side by a pair of relief ports wherein the area of the latter are substantially equal to the area of the former, thus providing a balanced loading on the spindle and preventing a freezing of the rotor assembly at the time of starting.

It is an object of this invention to provide an improved axial piston motor.

Another object of this invention is the provision of an axial piston motor wherein the spindle is stationary and the piston assembly is rotatably mounted thereon.

A further object of this invention is to provide an axial piston motor wherein the inlet port in the spindle is balanced by a pair of fluidly connected relief ports disposed on the opposite side of the spindle.

Yet another object of this invention is to provide an axial piston motor which is extremely efficient, compact in size, and which is mounted inside a wheel or the like.

Yet a further object of this invention is the provision of an axial piston motor which is extremely functional, simple in construction, and economical to manufacture.

Still another object of this invention is to provide an axial piston motor employing thrust races which are snap fit to the angle plate.

These objects and other features and advantages of this invention will become more readily apparent upon reference to the following description when taken in conjunction with the appended drawings.

In the drawings, as hereinafter described, a preferred embodiment is depicted, however various other modifications and alternate constructions can be made thereto without departing from the true spirit and scope of the invention.

DESCRIPTION OF THE PREFERRED EMBODIMENT

Figure 1:
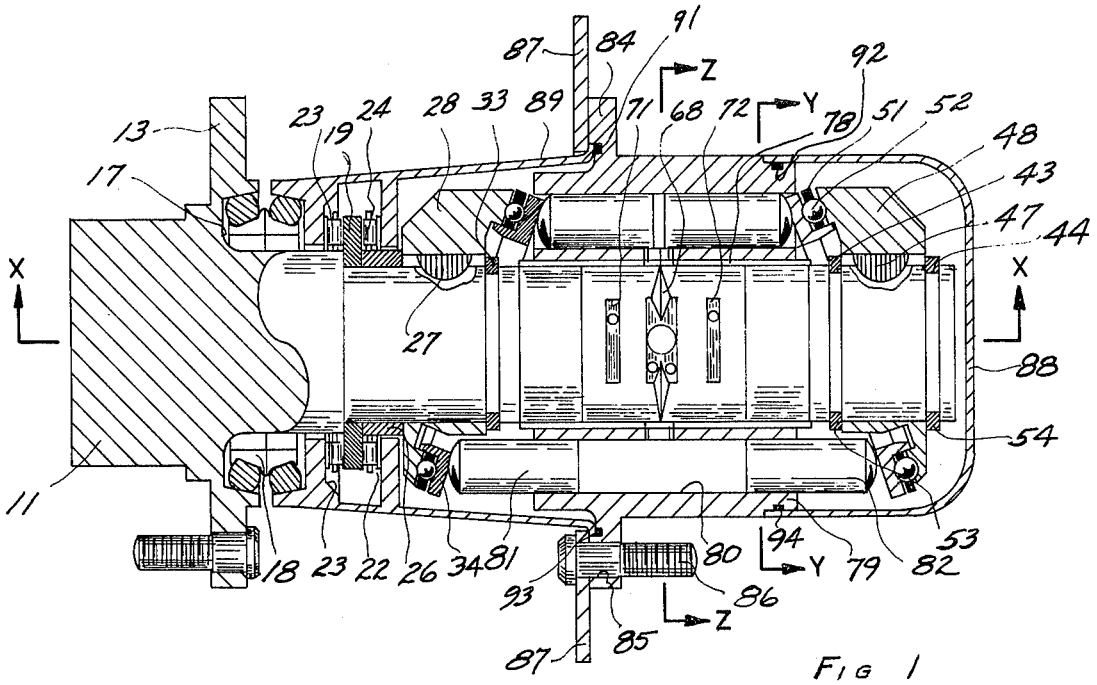
FIG. 1 is a sectional view taken along the axis of the axial piston motor of this invention.

The axial piston motor of this invention, disclosed generally at 10 in FIG. 1, comprises a spindle 11 and a rotor assembly 12. The spindle 11 is turned from a casting, or the like, and an annular radially projecting mounting flange 13 is formed proximate one end thereof. Approximately the right two thirds of the spindle is turned to a smaller diameter thus forming an annular ledge 15. A plurality of spaced holes 16, only one of which is shown, are drilled in the flange for receiving bolts or the like, for facilitating the attachment of the spindle to a frame (not shown). An annular slot 17 is formed in the flange for receiving a seal unit 18. Spaced from the seal unit 18 is an annular thrust plate 19 having a race 21 and 22 disposed on each side thereof, and wherein the inner end of one side of the thrust plate seats against the ledge 15. Mounted in each race are thrust bearing assemblies 23 and 24.

An annular spacer 26 is disposed against the thrust plate, and the thrust bearing assembly 24 rides thereon. Secured by a key 27 to the spindle 11 and spaced from the thrust bearings by the spacer 26 is a first angle plate 28.

Figure 7:
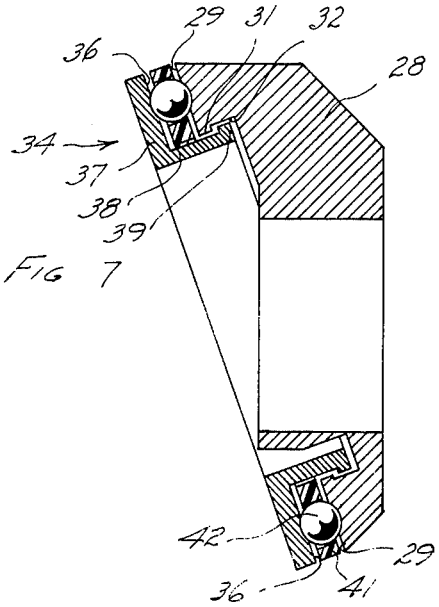
FIG. 7 is a sectional view of the interconnection of one of the thrust races and its corresponding angle plate.

The first angle plate 28 (FIGS. 1 and 7) has a bearing wall 29 disposed angularly to the axis of the spindle. An integral collar 31 projects inwardly from the plate 28 at the bearing wall to form an annular recess 32 behind the bearing wall 29. Adjacent the inner edge of the plate 28, a first annular groove 32 is formed in the spindle and a snap ring 33 is disposed therein for holding the plate 28, the spacer 26 and the thrust plate 19 in position on spindle. Snapped into the first bearing assembly plate 28 is a thrust race 34 having a bearing wall 36 spaced from the plate bearing wall 29. The thrust race 34 is annular and in cross-section L-shaped. The inside wall of leg 37 of the thrust race forms the bearing wall 36. Integral with the base 38 of the thrust race 34 and projecting upwardly wherein it is parallel to the leg 37 is an annular flange 39. The internal diameter of the base 38 is slightly larger than the internal diameter of the collar 31 and thus the internal diameter of the annular flange 39 is slightly smaller than the internal diameter of the collar thereby providing a snap fit between the thrust race 34 and the bearing assembly plate 38. An annular bearing cage 41 having bearings 42 mounted therein is disposed between the bearing walls 29 and 36 of the angle plate and the thrust race respectively.

Figure 4:
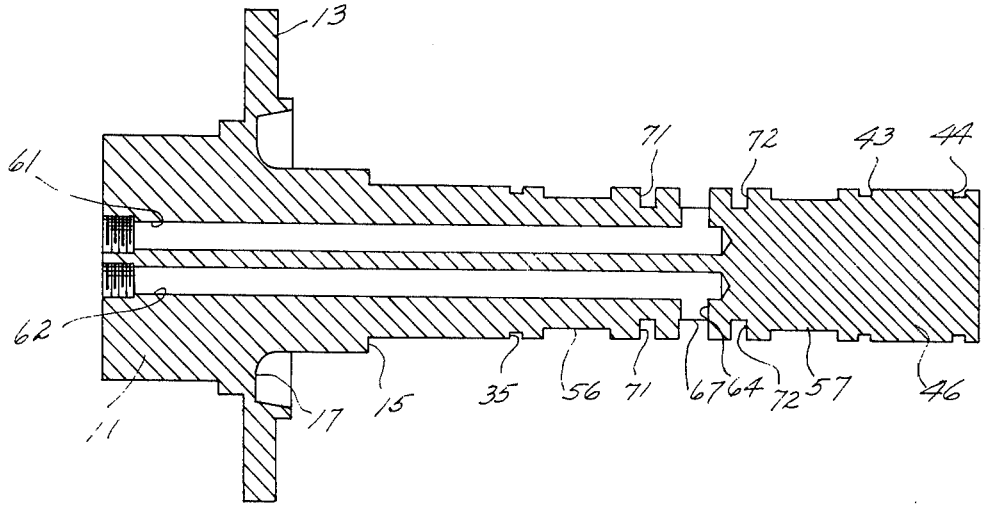
FIG. 4 is a sectional view taken along the lines X — X in FIG. 1 of the spindle only.
Figure 5:
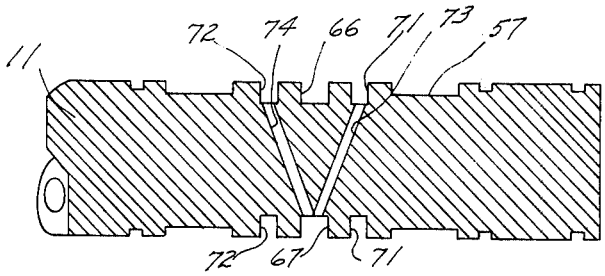
FIG. 5 is a partial sectional view of the spindle rotated slightly to disclose a portion of the relief ports of the invention.
Figure 6:
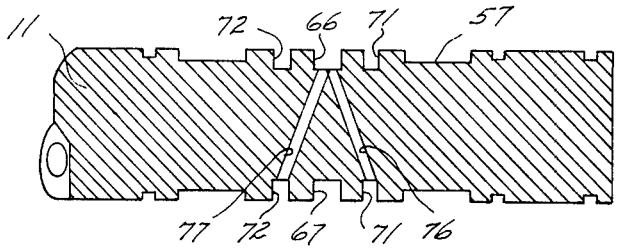
FIG. 6 is a partial sectional view of the spindle showing the other portion of the relief ports.

Spaced from the first annular groove 32 (FIGS. 1 and 4) are a second and third parallel annular groove 43 and 44, wherein the third annular groove 44 is disposed proximate the other end 46 of the spindle 11. Disposed on and secured by a key 47 to the spindle 11 between the grooves 43 and 44 is a second angle plate 48, thrust race 49, bearing cage 51 and bearings 52. As each of these parts are identical to the first assembly plate 28, thrust race 34 and bearing cage and bearings 41 and 42 respectively, they will not again be described. Snap rings 53 and 54 are disposed in the grooves 43 and 44 for retaining the angle plate 48 therebetween. Spaced annular bearing grooves 56 and 57 are formed in the spindle 11 with one of the grooves 56 disposed adjacent the first annular grooves 32 and the other 57 formed adjacent the second annular groove 43. A plurality of axial aligned needle bearings 58 are disposed in each groove 56 and 57.

Figure 2:
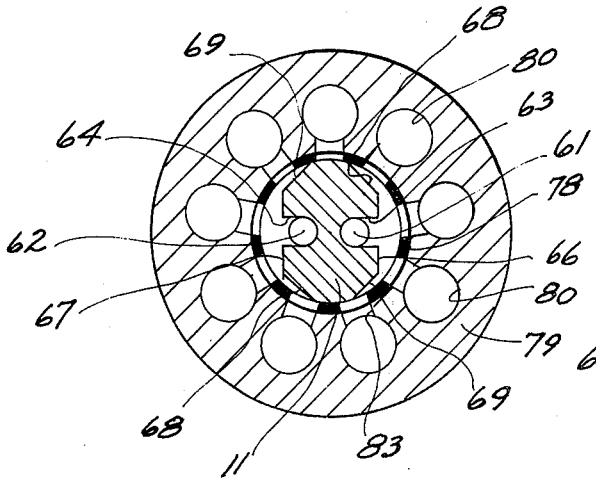
FIG. 2 is a sectional view taken along the lines Z — Z in FIG. 1.

A pair of spaced axial disposed passages 61 and 62 (FIGS. 2 and 4) are drilled from the left end of the spindle and extend almost to the second needle bearing groove 57. Proximate the inner end of each passage 61 and 62, a radial passage 63 and 64 fluidly interconnect with the axial passages 61 and 62 respectively. An enlarged inlet port 66 and outlet port 67 are milled into the spindle at the radial passages 63 and 64 respectively. It will be noted in FIG. 2 that each port 66 and 67 extends approximately 90° and the ports are opposed. At each edge of the ports are troughs 68 and 69 (FIGS. 1 and 2) milled in the spindle to increase the effective area of the port. Spaced on each side of each port 66 and 67 are a pair of slots 71 and 72 (FIGS. 1 and 4) milled into the spindle. The area of each slot 71 or 72 is equal to approximately one-half the area of the port 66 or 67. A relief hole 73 is drilled from the port 67 to the slot 71 disposed on the opposite side of the spindle, and a second relief hole 74 is drilled from the port 67 to the slot 72 disposed on the opposite side of the spindle. Similar relief holes 76 and 77 are drilled from the port 66 to the slots 71 and 72 disposed opposite thereto.

Figure 3:
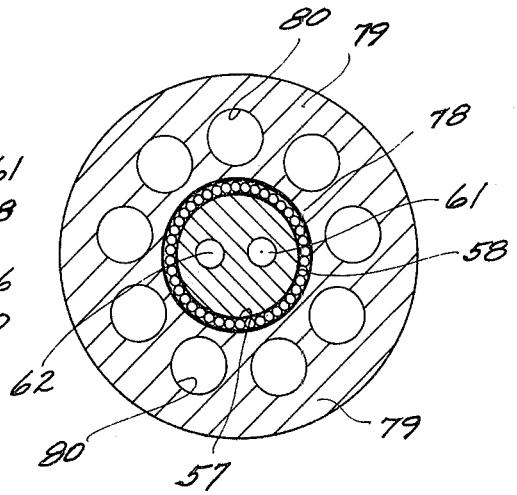
FIG. 3 is a sectional view taken along the lines Y — Y in FIG. 1.

The rotor assembly 12 (FIGS. 1 and 3) includes an annular rotor sleeve 78 rotatably mounted on the needle bearings 58 with the ends of the sleeve disposed proximate the angle plates wherein there is a fixed clearance between the rotor sleeve and the spindle. Mounted on the rotor sleeve 78 is a rotor 79 having a nine spaced cylinder bores 80 formed axially therethrough. Slidably disposed in each bore 80 is a pair of opposed pistons 81 and 82. The end of each piston 81 and 82 rides on the thrust race 34 and 49 respectively. Each cylinder bore 80 is fluidly connected to a radial port 83 which is drilled radially from the center of the rotor 79. An annular flange 84 projects radially from the rotor 79 and has a plurality of spaced holes 85 (only one of which is disclosed in FIG. 1) formed axially therein. Secured to the flange 84 by studs 86 is a wheel (only part of which is shown in FIG. 1). Covering the right end of the spindle and assembly is an end cover 88 and covering the left end of assembly is an assembly cover 89.

A pair of O ring slots 91 and 92 are formed in the outer surface of the rotor and O rings 93 and 94 are disposed therein to provide a seal between the rotor 79 and end cover 88 and the rotor and one end of the assembly cover 89. The other end of the assembly cover 89 mounts on the seal 18.

In operation fluid under pressure is carried from a pump (not shown) through the spindle 11 via the passage 61 to the radial passage 63, and into the port 66. The fluid in the port 66 flows into the radial port 83 of the cylinder bores disposed adjacent thereto and causes the pistons to move outwardly of each other with the ends of the pistons acting on the thrust races 34 and 49 to provide rotary motion to the assembly. Because the thrust races are secured to the angle plate by the snap action, or the like, the assembly can free wheel with the pistons in a contracted position and not with the ends against the thrust race. It will be noted in FIG. 2 that four of the cylinder bores at any moment are in fluid communication with the inlet port 66, four with the exhaust port 67 and one is blocked from both ports. The troughs on each end of each port are to prevent sudden actions on the pistons thus providing a smoother action.

To balance the pressures on opposed sides of the spindle the relief holes 73, 74, 76 and 77 permit the fluid to flow radially through the spindle from the inlet side to the exhaust side of the spindle.

I claim:

1. An axial piston motor comprising:

a fixed spindle having at least one annular bearing groove formed therein and including a plurality of axial aligned needle bearings disposed in said groove;

at least one angle plate secured to said spindle and having a bearing wall disposed at an angle to the axis of the plate;

a thrust race detachably mounted on said angle plate and disposed parallel to said bearing wall;

a rotor assembly means rotatably mounted on said spindle, said assembly including an annular sleeve rotatably mounted on said needle bearings and a rotor mounted on said annular sleeve having a plurality of cylinder bores formed therethrough;

a plurality of pistons mounted in said plurality of cylinder bores in said rotor and coactable with said thrust race;

fluid conduit means fluidly communicable with said pistons for carrying fluid to and from said pistons to cause said pistons to coact with said thrust race for rotating said assembly;

pressure balancing means formed in said spindle in fluid communication with said fluid conduit means; and said pressure balancing means comprises at least one relief hole formed diametrically through said spindle.

2. An axial piston motor as defined in claim 1 wherein said conduit means includes an inlet passage and an exhaust passage disposed axially in said spindle, an inlet port formed in said spindle; an inlet radial passage interconnecting said inlet passage and said inlet port; an exhaust port formed in said spindle diametral of said inlet port; an exhaust radial passage interconnecting said exhaust passage and said exhaust port; said pressure balancing means including a relief port disposed in said spindle substantially adjacent said exhaust port and fluidly connected to said inlet port by said relief hole drilled through said spindle.

3. An axial piston motor as defined in claim 2 and including troughs formed in said spindle and extending circumferentially from each said port to increase the effective area of each said port to prevent the sudden flow of fluid to said pistons from said inlet passage and from said piston to said exhaust passage.

4. An axial piston motor as defined in claim 2 wherein said balancing means comprises a second relief port disposed in said spindle substantially adjacent said inlet port and fluidly connected to said exhaust port by a second relief hole drilled through said spindle.

5. An axial piston motor as defined in claim 3 wherein said balancing means includes a third relief port disposed in said spindle parallel to said first relief port with said exhaust port disposed therebetween; a third relief hole formed through said spindle and fluidly interconnecting said inlet port and said third relief port; a fourth relief port disposed in said spindle parallel to said second relief port with said inlet port disposed therebetween; and a fourth relief hole formed through said spindle and fluidly interconnecting said exhaust port and said fourth relief port.

6. An axial piston motor as defined in claim 5 wherein the combined area of said first and third relief ports is substantially equal to the area of said inlet port and the combined area of the said second and fourth relief ports is substantially equal to the area of said exhaust port.

7. An axial piston motor comprising:

a fixed spindle;

at least one angle plate secured to said spindle and having a bearing wall disposed at an angle to the axis of the plate;

a thrust race detachably mounted on said angle plate and disposed parallel to said bearing wall;

a rotor assembly means rotatably mounted on said spindle;

a plurality of pistons mounted in said assembly and coactable with said thrust race;

fluid conduit means fluidly communicable with said pistons for carrying fluid to and from said pistons to cause said pistons to coact with said thrust race for rotating said assembly;

said angle plate having a collar projecting inwardly therefrom to form a recess behind said bearing wall; and said thrust race is annular and in cross section L-shaped, wherein said L-shape provides a base leg connected to a bearing leg and the free end of said base leg coacts with said recess to detachably lock said thrust race to said angle plate.

8. An axial piston motor as defined in claim 7 and including a bearing cage assembly disposed between said bearing wall and said bearing leg.

9. An axial piston motor as defined in claim 8 and including an annular flange secured to the free end of said base leg for seating in said recess, with the diameter of said flange being greater than the diameter of the collar thus providing a snap lock therebetween.

* * * * *